US005779534A

United States Patent [19]

Kunec

[11] Patent Number: 5,779,534

[45] Date of Patent: Jul. 14, 1998

[54] MULTIPLE STAGE AIRFLOW DIFFUSER APPARATUS FOR PAINT BOOTH

[75] Inventor: Richard J. Kunec, Canton, Mich.

[73] Assignee: Ford Global Technologies, Inc., Dearborn, Mich.

[21] Appl. No.: 792,914

[22] Filed: Jan. 21, 1997

[51] Int. Cl.[6] ..... B05B 15/12

[52] U.S. Cl. ..... 454/52; 454/296; 118/326

[58] Field of Search ..... 454/50, 51, 52, 454/284, 296; 118/326

[56] References Cited

U.S. PATENT DOCUMENTS

| | | | |
|---|---|---|---|
| 351,023 | 10/1886 | Davis . | |
| 1,117,174 | 11/1914 | Farmer . | |
| 1,915,867 | 6/1933 | Penick . | |
| 1,947,586 | 2/1934 | Fletcher . | |
| 2,119,282 | 5/1938 | Ludwig . | |
| 2,188,993 | 2/1940 | Ziegler . | |
| 2,247,891 | 7/1941 | Schneible . | |
| 2,306,727 | 12/1942 | Hill . | |
| 2,583,489 | 1/1952 | Meyer . | |
| 3,216,183 | 11/1965 | Larsson . | |
| 3,744,222 | 7/1973 | Delao . | |
| 3,996,025 | 12/1976 | Gulden . | |
| 4,027,407 | 6/1977 | Kiss | 37/61 |
| 4,133,255 | 1/1979 | Guice . | |
| 4,321,064 | 3/1982 | Vargo . | |
| 4,515,072 | 5/1985 | Crisp . | |
| 4,537,120 | 8/1985 | Josefsson . | |
| 4,715,395 | 12/1987 | Mainelli et al. . | |
| 5,042,420 | 8/1991 | Gerdes . | |
| 5,327,941 | 7/1994 | Bitsakis et al. . | |
| 5,480,349 | 1/1996 | Kolta . | |
| 5,512,017 | 4/1996 | Gore et al. | 454/52 |

FOREIGN PATENT DOCUMENTS

| | | | |
|---|---|---|---|
| 932138A | 5/1982 | U.S.S.R. | 454/284 |
| 1298493A | 3/1987 | U.S.S.R. | 454/284 |
| 1695062 | 11/1991 | U.S.S.R. | 454/284 |
| 5735 | of 1888 | United Kingdom . | |

*Primary Examiner*—Harold Joyce
*Assistant Examiner*—Derek S. Boles
*Attorney, Agent, or Firm*—Lorraine S. Melotik, Esq.; Roger L. May, Esq.

[57] ABSTRACT

A multiple stage airflow diffuser apparatus for spreading the airflow to provide a uniform airflow in a plenum. The diffuser includes a plurality of diffuser stages positioned in a spaced, nested relationship.

11 Claims, 2 Drawing Sheets

MULTIPLE STAGE AIRFLOW DIFFUSER APPARATUS FOR PAINT BOOTH

BACKGROUND OF THE INVENTION

1. Field of the Invention

The present invention relates generally to a vehicle paint booth, and more specifically, to a multiple stage airflow diffuser apparatus for use with a paint booth.

2. Description of the Related Art

Typically, a fully or partially assembled vehicle is transported, via a conveyor, into a paint booth wherein a desired color or colors are sprayed onto the vehicle either by a painter or a mechanized operation. During the paint spraying operation, paint sprays and mists accumulate within the paint booth and must be removed. Therefore, it is necessary to provide an air supply and an extraction system to supply air to, and remove paint laden air from the paint booth during and after the spraying operation.

If the airflow through the paint booth is not uniform, undesirable turbulence and randomly directed air streams are generated that carry paint droplets, mist, fumes and dust, etc., throughout the paint booth. Various attempts have been made to provide a paint booth that controls and directs the large quantities of air entering and exiting the paint booth. Therefore, there is a need in the art to provide a paint booth which controls and spreads the airflow such that a uniform airflow is produced throughout the interior of the paint booth.

SUMMARY OF THE INVENTION

Accordingly, the present invention is an airflow diffuser apparatus for uniformly spreading the airflow entering a plenum from an air supply such that the uniform spread provided by the airflow diffuser apparatus provides a uniform airflow to the bottom of the plenum. In the present invention, the airflow diffuser is a multiple stage diffuser formed of a plurality of diffuser stages arranged in a spaced, nested relationship. Each of the diffuser stages have perforations therein to spread the airflow entering the diffuser apparatus throughout the plenum such that there is a uniform airflow to the bottom of the plenum.

One advantage of the present invention is that the multiple diffuser stages, formed of individual diffuser boxes each surrounding the previous diffuser box, may be used to further diffuse the air entering the plenum. A further advantage is that the individual diffuser boxes are formed of a perforated plate, the size and number of perforations variable in order to properly spread the airflow.

Other features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
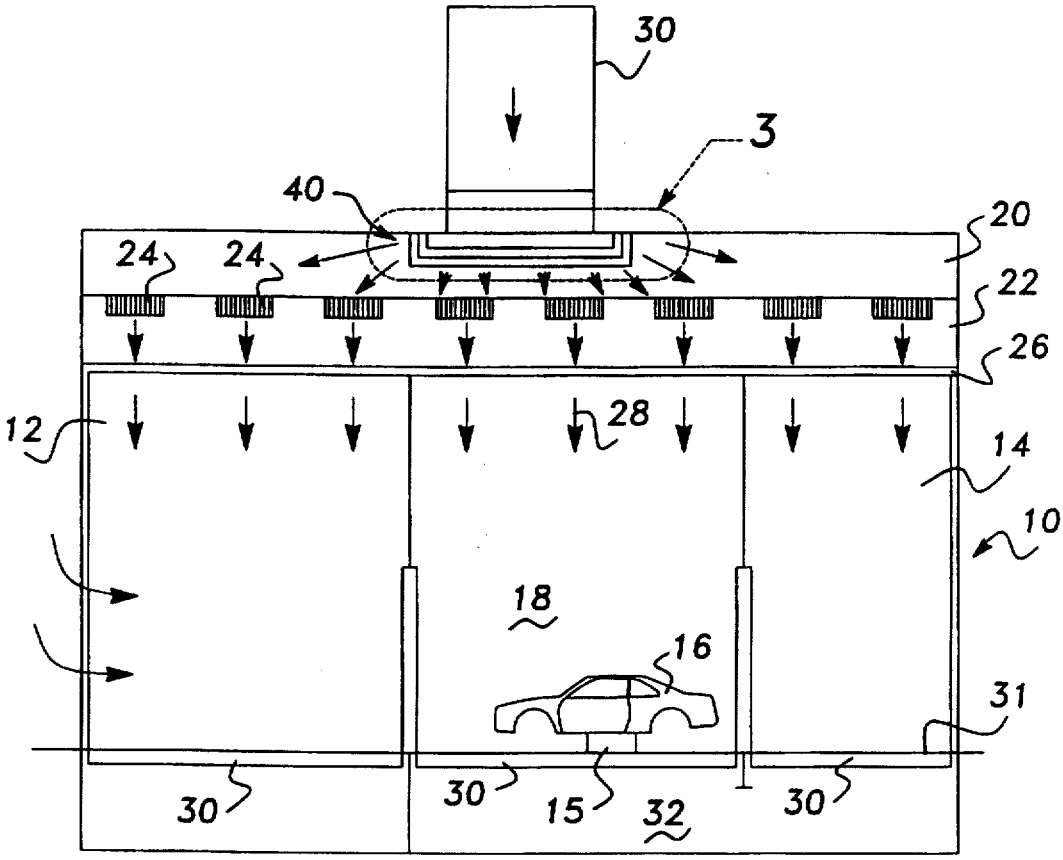
FIG. 1 is a schematic elevational view of a paint booth used with an airflow diffuser apparatus according to the present invention.
Figure 2:
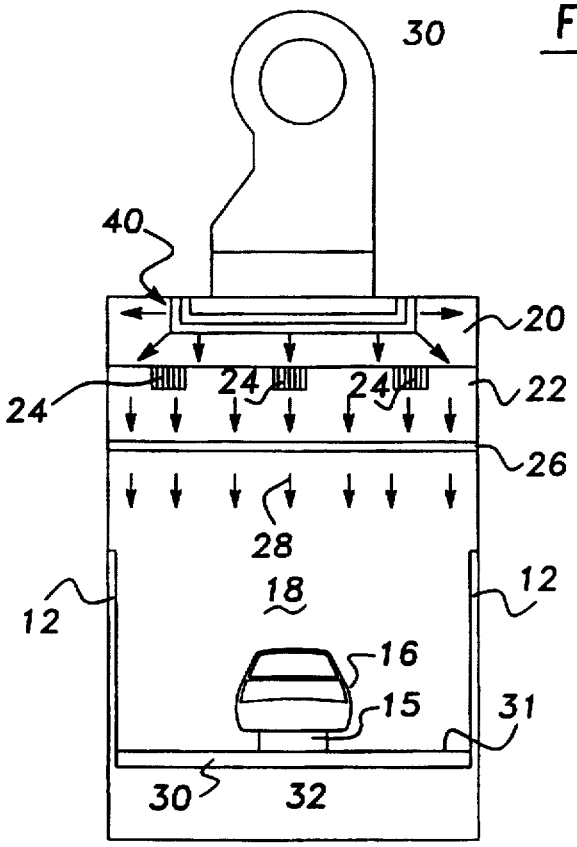
FIG. 2 is a schematic side view of the paint booth and airflow diffuser apparatus shown in FIG. 1.

Referring to FIGS. 1 and 2, a paint booth 10 having side walls 12 is shown. The paint booth 10 includes an opening 14 through which a vehicle 16 enters the interior 18 of the paint booth 10. Generally, the vehicle 16 is transferred through the paint booth 10 via a conveyor assembly 15 wherein the vehicle 16 is painted as it travels through the interior 18 of the paint booth 10.

The paint booth 10 includes an upper plenum 20 and a lower plenum 22 positioned adjacent the upper plenum 20. The upper plenum 20 receives air from an air supply 30. The air supply 30 fills the upper plenum 20 with air. The air exits the upper plenum 20 and enters the lower plenum 22 through a plurality of openings and filter bags 24. The air exits the lower plenum 22 through a ceiling filter 26 and flows in the direction shown by the arrows 28. Thus, air is supplied to the interior 18 of the paint booth 10 for withdrawing paint laden air from the paint booth 10. The air continues to flow around the vehicle 16 and exits the paint booth 10 through a grating 30 in the floor 31 of the paint booth 10. Upon exiting the paint booth 10, the air travels through a scrubber assembly 32 which removes the paint from the air allowing the air to be discharged.

Thus, it should be appreciated that the air enters the interior 18 or painting area through ceiling filters 26, is drawn downwardly in a generally vertical direction around the vehicle 16 being painted and out through the grating 30 into the scrubbers 32 prior to being discharged.

Figure 3:
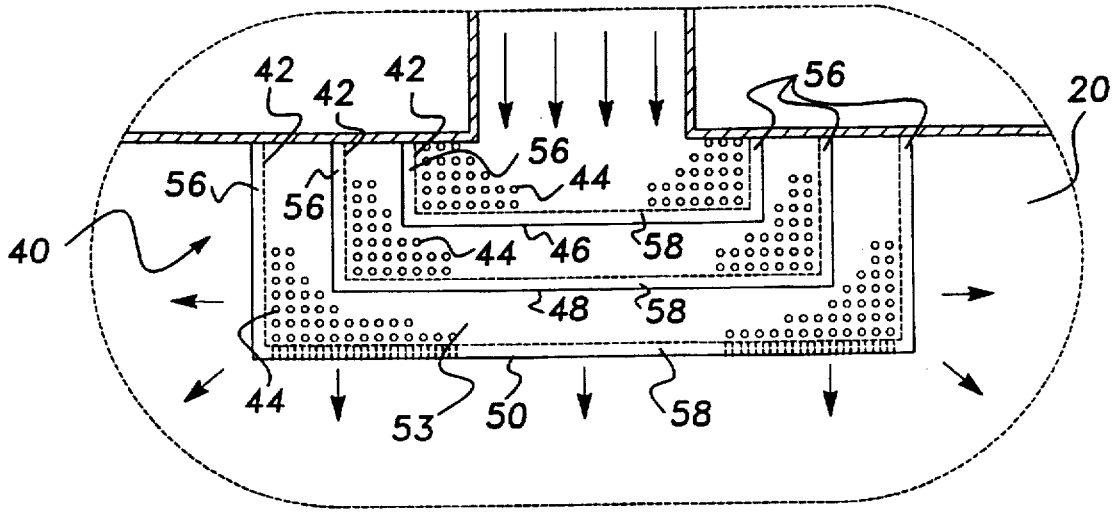
FIG. 3 is an enlarged view of the area shown in Circle 3—3 of FIG. 1.
Figure 4:
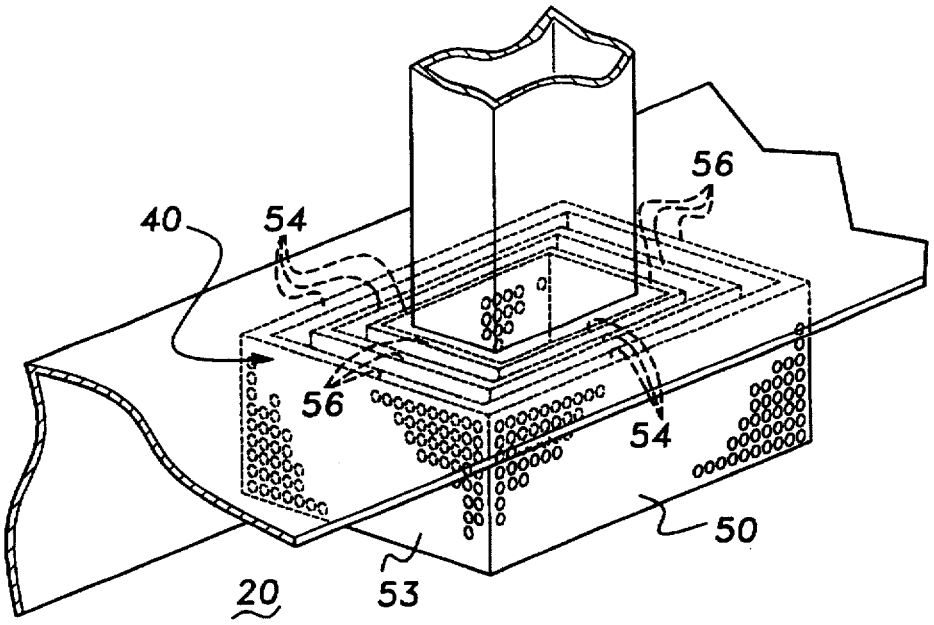
FIG. 4 is an enlarged perspective view of the airflow diffuser apparatus of FIGS. 1 and 2 with portions removed for clarity.

Turning now to FIGS. 3 and 4, a diffuser apparatus 40 for spreading an airflow generated by the air supply 30 and entering the upper plenum 20 is shown. The diffuser apparatus 40 provides uniform airflow to the bottom of the upper plenum 20. Thus the airflow from the upper plenum 20 to the lower plenum 22, through the filter bags 24, is uniform. Uniform airflow in the upper plenum 20 is important. Increased uniform flow in the upper plenum 20 results in increased uniform flow in the lower plenum 22 and correspondingly the interior 18 of the paint booth 10. As shown in FIG. 3, the diffuser apparatus 40 includes multiple stages wherein each stage tends to spread the airflow and create a uniform flow. The multiple stages are formed of a plurality of diffuser boxes 42 arranged in a spaced, nested relationship. Each of the diffuser boxes 42 contains perforations 44 through which the air entering the diffuser apparatus 40 flows.

In one embodiment, the diffuser apparatus 40 is formed of a first diffuser box 46, a second diffuser box 48 and a third diffuser box 50. As indicated, the size of each diffuser box from the first through the third increases such that the diffuser boxes may be nested within one another. Each of the first, second and third diffuser boxes 46, 48, 50 are formed of 18-gauge perforated plates 53 and include opposite side plates 54, opposite end plates 56 and a lower plate 58. The perforated plates 53 are typically connected to one another by welding them to a piece of angle iron which forms the corners. While shown herein with approximately fifty percent of the surface area of the plate covered with perforations, the number and size of the perforations; i.e., the percentage of void space, may be varied depending upon the desired flow path. Additionally, the amount or percentage of void space on each of the separate diffuser boxes 46, 48, 50 may vary. Also, while the diffuser apparatus 40 is shown herein in a rectangular pattern, it may also take other shapes such as cylindrical, triangular or polygonal depending upon the flow pattern desired. Thus, the rectangular box configuration used herein is for illustrative purposes only.

Depending upon the position of the diffuser apparatus 40 within the upper plenum 20, the number and size of the perforations may be varied. For instance, if the diffuser apparatus 40 is placed in the center of the upper plenum 20, the perforations 44 are typically equal on both of the ends of the diffuser apparatus 40. However, if the diffuser apparatus 40 is not centered within the upper plenum 20, it may be necessary to increase the size and number of perforations 44 on one end thereof adjacent the larger side of the upper plenum 20.

As set forth above, the diffuser apparatus 40 creates a resistance to the airflow entering the upper plenum 20. The resistance tends to spread the airflow in a uniform manner to provide a uniform airflow to the bottom of the plenum.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An airflow diffuser apparatus comprising:

a plenum having an air inlet;

an air supply connected to said plenum and supplying air to said plenum through said air inlet in said plenum; and a diffuser receiving air from said air supply through said air inlet, said diffuser including a plurality of diffuser stages arranged in a spaced, nested relationship.

2. An airflow diffuser apparatus as set forth in claim 1 wherein said diffuser stages includes first, second and third diffuser boxes.

3. An airflow diffuser apparatus as set forth in claim 2 wherein said first, second and third diffuser boxes are formed of a perforated plate.

4. An airflow diffuser apparatus for use with a paint booth for painting automotive vehicles comprising:

an air supply;

an upper plenum including an inlet, said upper plenum receiving air from said air supply through said inlet;

a lower plenum adjacent and communicating through a plurality of openings with said upper plenum, said air flowing from said upper plenum through said openings to said lower plenum; and a diffuser positioned within said upper plenum, said diffuser positioned adjacent said inlet and spreading the airflow entering said upper plenum through said inlet into said upper plenum in a manner providing a uniform flow through said openings to said lower plenum, said diffuser including a plurality of diffuser boxes arranged in a spaced, nested relationship.

5. An airflow diffuser apparatus as set forth in claim 4 wherein said plurality of diffuser boxes includes first, second and third diffuser boxes.

6. An airflow diffuser apparatus as set forth in claim 5 wherein said first, second and third diffuser boxes are formed of a perforated plate.

7. An airflow diffuser apparatus as set forth in claim 4 wherein each of said diffuser boxes is formed having opposite side plates interconnected with opposite end plates, and a lower plate interconnected to said side and end plates, said side plates, said end plates and said lower plate each having perforations therein.

8. An airflow diffuser apparatus as set forth in claim 6 wherein ten to fifty percent of said perforated plate is void space.

9. An airflow diffuser apparatus as set forth in claim 6 wherein the area of void space in said perforated plate is variable depending upon the position of the diffuser within the plenum and the desired airflow rate.

10. An airflow diffuser apparatus for evenly spreading flow from an air supply into a plenum comprising:

a plurality of diffuser boxes arranged in a spaced, nested relationship, each of said diffuser boxes having opposite side plates interconnected with opposite end plates and a lower plate connected to the side and end plates, said side and lower plates having perforations therein whereby each diffuser box creates a resistance to the airflow from the air supply which tends to spread the airflow wherein said perforations cover ten to fifty percent of said side, end and lower plates.

11. An airflow diffuser apparatus as set forth in claim 10 wherein said plurality of diffuser boxes includes first, second and third diffuser boxes.

* * * * *